US006857210B2

(12) United States Patent
Santa Cruz

(10) Patent No.: US 6,857,210 B2
(45) Date of Patent: Feb. 22, 2005

(54) GENETIC IDENTIFICATION SYSTEM

(76) Inventor: Julio Santa Cruz, 1725 Marseilles Dr. #1, Miami, FL (US) 33141

( * ) Notice: Subject to any disclaimer, the term of this patent is extended or adjusted under 35 U.S.C. 154(b) by 0 days.

(21) Appl. No.: 10/431,933

(22) Filed: May 8, 2003

(65) Prior Publication Data

US 2004/0221494 A1 Nov. 11, 2004

(51) Int. Cl.[7] ..... G09F 1/00

(52) U.S. Cl. ..... 40/124.06; 40/625; 283/75; 283/77; 283/78

(58) Field of Search ..... 40/124.01, 124.06, 40/625; 283/75, 77, 78

(56) References Cited

U.S. PATENT DOCUMENTS 2,712,514 A * 7/1955 English ..... 283/77
3,412,493 A * 11/1968 French ..... 283/77
4,276,704 A * 7/1981 Heller ..... 283/77
4,870,764 A * 10/1989 Boone ..... 40/124.06
6,224,109 B1 * 5/2001 Yang ..... 283/77
6,322,655 B1 * 11/2001 Casagrande ..... 40/625
2003/0086591 A1 * 5/2003 Simon ..... 382/115

* cited by examiner

*Primary Examiner*—Gary C. Hoge
(74) *Attorney, Agent, or Firm*—David P. Lhota, Esq.; Stearns Weaver Miller; Weissler Alhadeff & Sitterson, P.A.

(57) ABSTRACT

A genetic identification card having read only memory (ROM) for storing identity related information, a microcircuit, a magnetic recordable strip and an incorporated capsule adapted for storing a biological sample of the individual. The card is waterproof and may include a laminated or printed photograph, developed fingerprint, point of contact telephone number, magnetic recordable strip, and capsule containing a sample of biological origin. The identification system facilitates the production of a permanent identification card containing information necessary to positively identify a human being. The system will also include a means to check and verify the identity of the card owner through DNA sampling and testing.

13 Claims, 1 Drawing Sheet

GENETIC IDENTIFICATION SYSTEM

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention generally relates to an identification device, and more particularly, to a genetic identification system having a read-only microcircuit, magnetic recordable strip and capsule adapted for containing a sample of biological origin.

2. Description of Related Art.

Identifying bodies involved in critical and fatal accidents can be very difficult, especially if the body is mutilated beyond recognition. If a card existed that could store identifying information and biological samples, it would facilitate positive identification of individuals. The instant invention addresses this need.

Several identification cards are known in the prior art, however, they are complicated and fail to address the problem of determining the identity of individuals as contemplated by the instant invention. For instance, U.S. Pat. No. 4,208,795, issued to Muhlemann, discloses an identification plate of gold alloy inserted in a small blind hole drilled into the crown of a tooth. The hole is then filled with a durable filler which hardens around the plate to embed it in a durable, heat resistant filling. The filling material can be colored so that it is readily located when identification is desired. For making identification, the filler is dissolved away to leave the plate, which can be read by means of optical magnification. U.S. Pat. No. 4,284,296, issued to Evans, discloses an asbestos card embossed with identification indicia. The card is enclosed in a fire-resistant ceramic holder. The identification device is for use on aircraft, ships and railroads and in industrial plants. U.S. Pat. No. 4,999,065, issued to Wilfert, discloses an identification card that converts a photograph from a video camera to digital data and reproduces it with high-fidelity on a video display screen. Signatures and fingerprints can be treated in a similar manner using either a video camera or a CCD (charge coupled device). U.S. Pat. No. 5,053,608, issued to Senanayake, discloses an identification card having an encoded version of the user's fingerprint thereon. The encoded version is readable by a machine that directly compares it at the time of use to a fingerprint impression stored on a designated area of the card. U.S. Pat. No. 6,213,391, issued to Lewis, discloses a system for identifying an individual either by generating an identification profile based on a distinctive biometric characteristic possessed by that person (e.g., voice analysis, fingerprint, facial scan, DNA) or by means of verifying a digital "signature" assigned to that person.

As above noted, the prior art fails to disclose an identification card having read-only-memory (ROM), a microcircuit, a magnetic recordable strip and a capsule that contains a biological sample of the card owner. The instant invention addresses this need in the prior art by providing an identification card having these characteristics.

BRIEF SUMMARY OF TEE INVENTION

The instant invention comprises a genetic identification card having read only memory (ROM) for storing identity related information, a microcircuit, a magnetic recordable strip and an incorporated capsule adapted for storing a biological sample of the individual. The card is preferably waterproof and may include a laminated or printed photograph, developed fingerprint, point of contact telephone number, magnetic recordable strip, and capsule containing a sample of biological origin. The identification system facilitates the production of a permanent identification card containing information necessary to positively identify a human being. The system will also include a means to check and verify the identity of the card owner through DNA sampling and testing.

The genetic identification card may be manufactured with plastic, metal or ceramic. The card may incorporate any number of permanent identifiers specific to the individual being identified. These identifiers may be imprinted, laminated onto the card's surface, stored on the magnetic recordable strip or recorded on the read only memory (ROM) microcircuit. Pertinent data identifying the bearer is recorded using one or more of these techniques. The microcircuit may also be stored in the capsule.

The genetic identification system and card include a capsule adapted for storing one or more biological samples that can be processed to extract DNA. The capsule may contain several types of samples that would provide differing degrees of resistance to degradation. Data obtained from processing this sample would be compared with a previously obtained sample or a sample obtained from the individual to verify the actual identity. The results of sample analyses may be maintained in a database that numerically catalogs the samples for rapid retrieval and computer processing.

In light of the foregoing, it is an object of the present invention to provide a genetic identification card and system.

It is another object of the instant invention to provide a genetic identification card with an incorporated read only memory (ROM) microcircuit.

It is an additional object of the instant invention to provide a genetic identification card with an incorporated magnetic recordable strip.

It is a further object of the instant invention to provide a genetic identification card with an incorporated capsule that is adapted for storing a biological sample.

It is yet another object of the instant invention to provide a genetic identification card with an incorporated read only memory (ROM) microcircuit, magnetic recordable strip and an incorporated capsule to contain a sample of biological origin.

In accordance with these and other objects, which will become apparent hereinafter, the instant invention will now be described with particular reference to the accompanying drawings.

DETAILED DESCRIPTION OF THE INVENTION

Figures 1, 2:
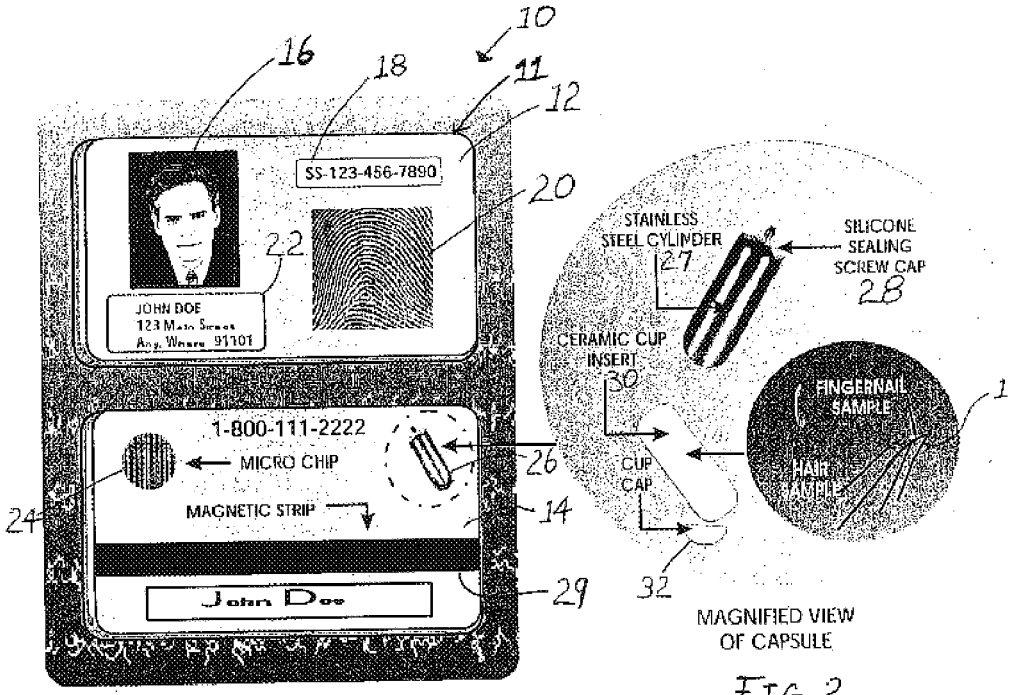
FIG. 1 is a front elevational view of the preferred embodiment of the genetic identification card of the instant invention.
FIG. 2 is an exploded view of the preferred embodiment of the biological sample storing capsule of the instant invention

With reference to the drawings, FIGS. 1 and 2 depict the preferred embodiments of the instant invention which is generally referenced by the numeric character 10 and, or as a genetic identification system or card. The genetic identification system 10 comprises a genetic identification card 12 and software that is stored and processed in a central processing unit (CPU) for coordinating, storing, processing, retrieving and displaying information related to the card 11 and its stored data The genetic identification card 11 comprises a substrate having a front side 12 and backside 14. The front side 12 comprises a photograph 16 of the card owner, identifying indicia 22, social security number 18 and fingerprint 20 of the card owner. The back side 14 comprises a micro chip 24 and biological sample capsule 26, which may be at least partially disposed between the front and back side 12, 14, and magnetic strip 29, which stores selected information on the card owner.

With reference to FIG. 2, the biological sample capsule 26 comprises a stainless steel cylinder 27, silicone sealing screw cap 28 and ceramic cup insert 30. The ceramic cup insert 30 includes a cup cap 32, stores the biological sample 1, such as hair or fingernail samples, and fits inside the stainless steel cylinder 27. In an alternative embodiment, the biological sample may be stored directly in the cylinder 27. The capsule 26 is adapted to store other types of biological samples. In another embodiment, the stainless steel cylinder 27 may be adapted to store the biological sample.

The body of the card 12 may be manufactured from plastic, stainless steel or ceramic composition. The card 12 preferably includes lamination, which may comprise a plastic or ceramic film that allows the photograph and/or fingerprint to be read by sight or machine. The magnetic strip 29 may be a layer of bonded ferrite, chromium oxide or a cen-net that will allow permanent recording of the identity data of the bearer. The read only memory (ROM) module comprises a semiconductor microchip preferably having a silicon or gallium arsenide matrix.

The capsule 26 comprises a refractory ceramic capsule with a tight fitting cap 28. The capsule 26 and, or cap may comprise a high nickel stainless steel, Inconel or similar heat resistant metal-capped cylinder. The metallic cylinder 27 has a threaded body and cap 28 that provides an air tight and watertight seal when threaded together. A high temperature resistant gasket may be incorporated to enhance the reliability of the seal.

The genetic identification system 10 allows the user to carry an identification device that facilitates convenient identification of the bearer and is designed to survive an automobile accident, earthquake, terrorist bombing, flood, fire or similar disaster. The genetic identification system 10 includes the identification card 12, which has read only memory (ROM) and a microcircuit in the chip 24, magnetic strip 29 and capsule 26 that stores a biological sample. The card 12 preferably has the shape and size of a typical credit card. The body of the card 12 is preferably made from a water resistant plastic, metal or refractory ceramic. The invention 10 has a picture 16 and/or developed fingerprint 20 of the owner permanently attached to the card. The magnetic strip 29 is permanently attached to the card 12. The invention 10 stores personal data of the owner on the magnetic strip 29 and, or in ROM, which is incorporated into the microcircuit 24. The ROM and microcircuit 24 are permanently incorporated into the card 12. The capsule 26 contains the biological sample 1. In an alternative embodiment, the microcircuit 24 may be stored in a the capsule 26. The capsule 26 is preferably made from a refractory ceramic material. The cap 28 comprises a tight fitting lid that seals the capsule 26. The capsule 26 comprises a ceramic cup 30 that is contained in a high temperature and corrosion resistant metallic cylinder 27. The cylinder 27 is sealed by a threaded cap 32. The seal between the threaded cap 32 and cylinder 27 is air tight and water tight. A gasket may be included between the threaded cap 32 and cylinder 27 to provide an air fight and water proof seal. The gasket facilitates a waterproof and airtight seal. Data relating to the DNA sequencing of the biological sample contained in the capsule 26 is reduced to a mathematical code for rapid computer matching. A database of DNA sequencing results is maintained as part of the genetic identification system 10.

To use the instant invention, a biological sample, such as hair, fingernail clippings, body tissue or blood, is submitted to DNA sequence analysis upon registration with the genetic identification system. The DNA sequence data is stored in a database in a computer searchable format. The biological sample is then stored in the capsule 26. Pertinent information about the sample donor is printed on the identification card 12 and, or electronically recorded on a computer processing unit so that it may be accessed by the card 12. A photograph 16 and finger print 20 are affixed to or printed on the identification card 12. The identification card 12 should be carried at all times to provide positive identification without the bearer needing to be alive or cognizant. The identity of a set of remains is verified by comparing the DNA sequence of the corpse with the contents of the capsule 26.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An identification card for storing information that identifies the card's owner, said card comprising:

a substrate having opposite surfaces;

a photographic image on one of said surfaces;

a fingerprint image on one of said surfaces;

a magnetic strip on one of said surfaces, said magnetic strip being adapted for storing data related to the card's owner; and a capsule secured to said substrate adapted for storing a biological sample of the card's owner, said capsule comprising a cylinder, a cup adapted for fitting in said cylinder and a cap adapted for mounting to an open top end of said cylinder.

2. A card as recited in claim 1, further comprising:

a microchip secured to said substrate for storing and processing data related to the card's owner.

3. A card as recited in claim 1, further comprising:

indicia that identifies the card's owner.

4. A card as recited in claim 1, wherein said substrate is made from a plastic based material.

5. A card as recited in claim 1, further comprising software adapted for retrieving data from said microcircuit and magnetic strip.

6. A card as recited in claim 1, wherein said capsule comprises ceramic.

7. A card as recited in claim 1, wherein said cup comprises ceramic.

8. An identification card for storing information that identifies the card's owner, said card comprising:

a substrate having opposite surfaces;

a photographic image on one of said surfaces;

a fingerprint image on one of said surfaces;

a magnetic strip on one of said surfaces, said magnetic strip being adapted for storing data related to the card's owner;

a microchip secured to said substrate for storing and processing data related to the card's owner, and a capsule secured to said substrate adapted for storing a biological sample of the card's owner, said capsule comprising ceramic.

9. A card as recited in claim 8, wherein said capsule comprises:

a cylinder;

a cup that is adapted for fitting in said cylinder; and a cap adapted for mounting to an open top end of said cylinder.

10. A card as recited in claim 9, wherein said capsule comprises ceramic.

11. A card as recited in claim 8, further comprising:

indicia that identifies the card's owner.

12. A card as recited in claim 8, wherein said substrate is made from a plastic based material.

13. A card as recited in claim 8, further comprising software adapted for retrieving data from said microcircuit and magnetic strip.

* * * * *